US006121862A

United States Patent [19]

von Eckroth et al.

[11] Patent Number: 6,121,862

[45] Date of Patent: Sep. 19, 2000

[54] MAGNETIC FLUX CONCENTRATOR SHIELD FOR USE IN OVERLOAD RELAY

[75] Inventors: Kurt von Eckroth, Oconomowoc; James A. Becker, Grafton; Jan J. Walker, Franklin, all of Wis.

[73] Assignee: Eaton Corporation, Cleveland, Ohio

[21] Appl. No.: 09/267,972

[22] Filed: Mar. 12, 1999

[51] Int. Cl.[7] ..... H01H 75/00; H01H 77/00; H01H 83/00; H01H 71/10; H01H 71/20

[52] U.S. Cl. ..... 335/6; 335/8; 335/155; 335/177; 335/174; 335/202; 361/42; 361/44; 361/46; 361/102; 324/127; 336/175

[58] Field of Search ..... 335/6–10, 21–23, 335/35–42, 155, 172–176, 202, 236, 237; 361/78–93, 102, 42–50; 336/175, 176; 324/126–129, 117 R, 117 H; 310/42, 216–218, 254, 258, 259, 261

[56] References Cited

U.S. PATENT DOCUMENTS 4,934,042 6/1990 Bush ..... 29/598

5,043,616 8/1991 Katsuzawa et al. ..... 310/91

*Primary Examiner*—Michael L. Gellner

*Assistant Examiner*—Ray Barrera

*Attorney, Agent, or Firm*—Boyle Fredrickson Ziolkowski S.C.

[57] ABSTRACT

A magnetic flux concentrator shield is disclosed for use with magnetic flux sensors in an overload relay for multiple pole electromagnetic contactor applications. The magnetic flux concentrating shield has slotted layers of laminated members. The layers have a series of pole shielding slots which concentrate magnetic flux generated by conductors carrying current through conductor apertures in each layer. Magnetic flux sensors are positioned within air gaps within each pole of the shield. By shielding the generated magnetic flux from reaching the magnetic flux sensor of another pole, the pole shielding slots minimize cross pole magnetic flux sensor interference.

26 Claims, 4 Drawing Sheets

MAGNETIC FLUX CONCENTRATOR SHIELD FOR USE IN OVERLOAD RELAY

BACKGROUND OF THE INVENTION

The present invention relates generally to overload relays for electromagnetic contactors, and more particularly to a magnetic flux concentrator shield for use in an overload relay that minimizes cross pole magnetic flux interference in multiple pole contactor applications.

It is often times desirable in industrial applications to reduce the size of electrical devices, such as motor starters, while maintaining the rated electrical capacity. It is known to use Hall effect sensors for measuring current in a conductor when available space is critical. Multiple phase starters utilize a separate pole for each phase. Reducing the size of the contactor and overload relay of the starter reduces spacing between each pole. When sensitive devices such as Hall effect sensors are used, cross-pole magnetic flux contamination presents a problem. Magnetic flux generated by current flowing through a conductor in one pole may stray to an adjacent pole and be sensed by the Hall effect sensor in the adjacent pole, thereby affecting the accuracy and control function of the sensors and associated electronics. Therefore, it would be beneficial to have a magnetic flux shield in the overload relay that concentrates the magnetic flux generated by current through a conductor the flux straying into cent pole.

SUMMARY OF THE INVENTION

The present invention provides a magnetic flux concentrating shield that concentrates magnetic flux within a particular pole section while minimizing cross pole magnetic flux interference.

In accordance with one aspect of the invention, a magnetic flux concentrating shield comprises a slotted layer having a plurality of poles and a plurality of conductor apertures each capable of receiving a conductor therethrough. The shield includes a series of pole shielding slots which are at least partially located between the conductor apertures. Each pole has an inner magnetic flux path section on the layer surrounding each conductor aperture. Magnetic flux generated by each conductor is concentrated within each pole and stray magnetic flux generated by each conductor is substantially shielded from the inner magnetic flux path section of an adjacent pole by the pole shielding slots.

In accordance with another aspect of the invention, the magnetic flux concentrating shield comprises a plurality of slotted layers. Each slotted layer has a first, second and third conductor apertures. The magnetic flux concentrating shield includes a pair of substantially linear pole shielding slots, with each pole shielding slot at least partially located between the conductor apertures, and a contoured pole shielding slot surrounding each inner magnetic flux path section. The substantially linear pole shielding slots and the contoured pole shielding slots shield magnetic flux generated by the conductor of one of the poles from the inner magnetic flux path section of another of the poles.

In accordance with another aspect of the invention, the magnetic flux concentrating shield comprises a plurality of laminated members. The magnetic flux concentrating shield includes a plurality of pole sections, each having an aperture to receive a conductor transversely therethrough. Each pole section includes an inner magnetic flux path section having an air gap. A magnetic flux sensor is disposed within the air gap of the inner magnetic flux path section. The magnetic flux concentrating shield further includes a plurality of pole shielding slots so that when electrical current flows through the conductor of each pole section, a resultant magnetic flux is substantially prevented by the pole shielding slots from straying to the magnetic flux sensor of another pole section. In this manner, cross-pole magnetic flux sensor interference is minimized.

Various other features, objects and advantages of the present invention will be made apparent from the following detailed description and the drawings.

DETAILED DESCRIPTION OF THE PREFERRED EMBODIMENT

Figure 1:
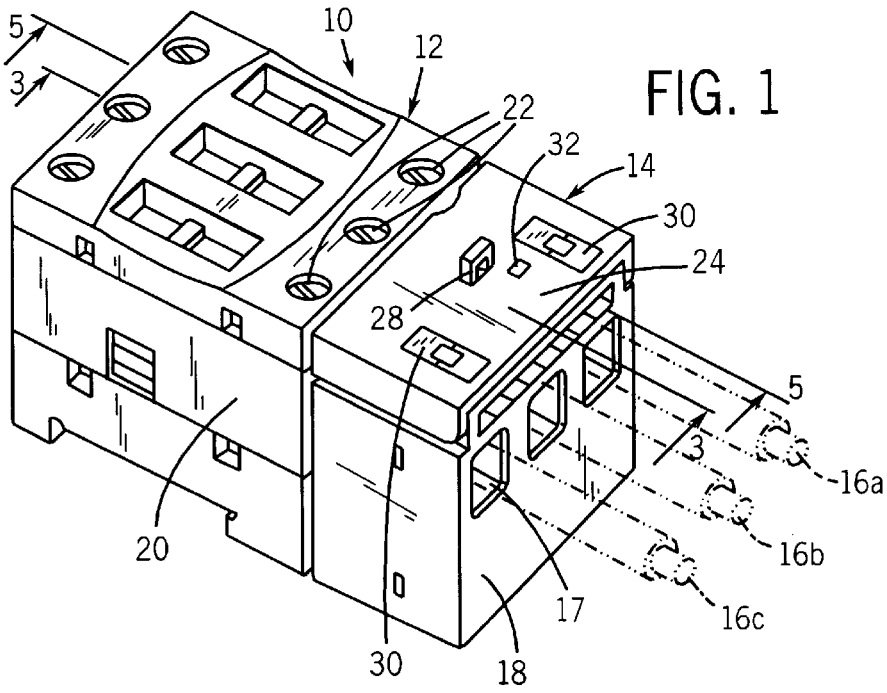
FIG. 1 is a perspective view of a contactor with an overload relay connected thereto to form a motor starter in accordance with one aspect of the present invention.

Referring to FIG. 1, a starter 10 is shown in perspective view. Starter 10 is a multi-phase starter as is used in industrial control applications, such as motor control, and includes contactor 12 and overload relay 14. Contactor 12 is an electromagnetic contactor for switching supply current to a motor (not shown), while the overload relay 14 senses and measures the current to the motor, and shuts off or de-energizes the contactor 12 if too much current (overload) is flowing to the motor, thus protecting the motor. Overload relay 14 is shown connected with the contactor 12. Overload relay 14 accepts a series of conductors 16*a*, 16*b* and 16*c* (shown partially in phantom) through overload relay housing 18, to contactor housing 20 to be secured by lugs 22. Overload relay 14 includes a pivotable cover 24 shown in a cover closed position. Overload relay cover 24 further includes an aperture (26 of FIG. 2) such that when cover 24 is in the cover closed position, a locking hasp 28 extends through cover 24 via aperture 26. Other items such as switches 30 and LED indicator 32 may also show through or extend through cover 24 in a similar manner.

Figure 2:
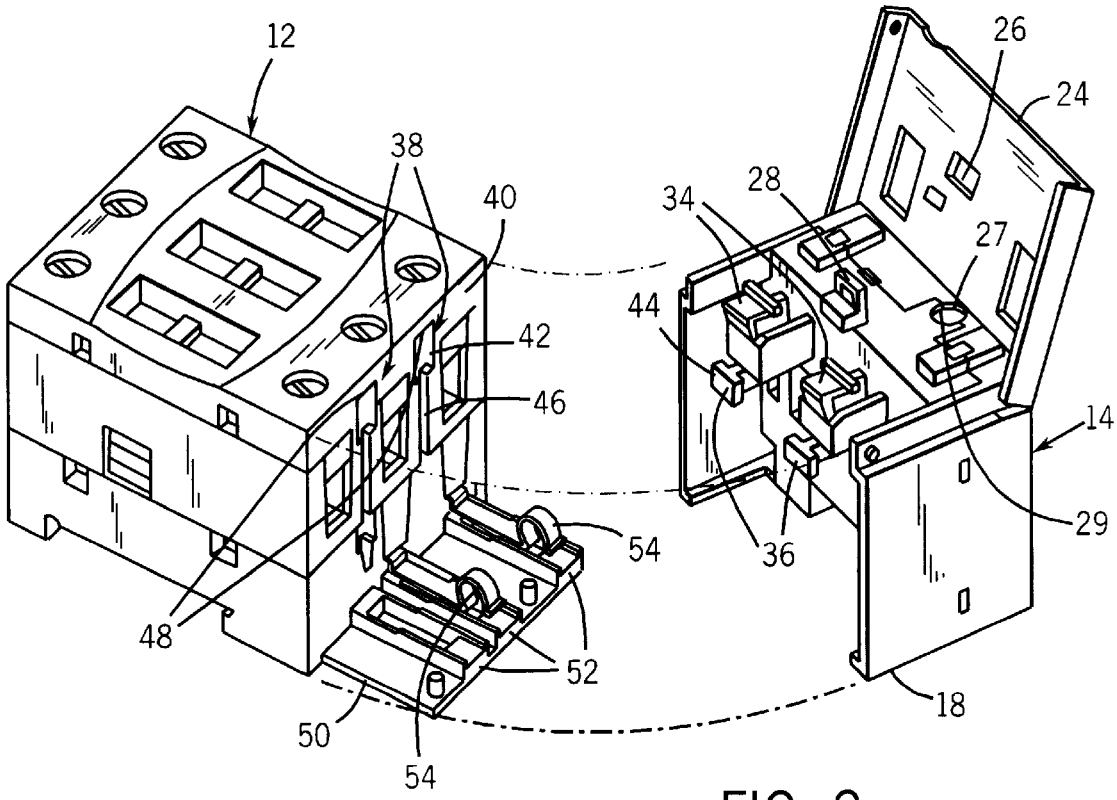
FIG. 2 is a perspective view of the starter of FIG. 1 with the contactor and the overload relay separated.

Referring to FIG. 2, the cover 24 of the overload relay 14 is shown in a cover open position. The cover 24 in the cover open position permits visualization of conductors 16*a*, 16*b* and 16*c* (of FIG. 1) as inserted through openings 17 in the overload relay 14 and into the contactor 12 during installation. Overload relay housing 18 includes a circular opening through which the rotary knob of a potentiometer 27 connected to a printed circuit board is disposed. Potentiometer 27 includes a screwdriver type slot 29 for adjustment of the full load amperage of the particular motor with which the starter 10 is to be used. Potentiometer 27 is covered when cover 24 is in the cover closed position, and a seal inserted through locking hasp 28 prevents unknown later adjustment of potentiometer 27.

Contactor 12 is shown separated from overload relay 14 in FIG. 2 to better show the connection therebetween. In order to make the connection, the overload relay 14 includes flexing lock tabs 34, which are each connected to a retaining projection 36. Preferably, retaining projection 36 is T shaped as will be described in further detail with respect to FIG. 6A–6C. Retainer projections 36 are insertable into connecting slots 38 within housing wall 40 of contactor 12. Each connecting slot 38 preferably has a general T shape with a receiving channel 42 for initially receiving the head 44 of retaining projection 36. Receiving channel 42 terminates at one end in a retaining channel 46 which is narrower than the receiving channel 42. During connection, the retaining projection 36 enters the receiving channel 42 and proceeds downwardly through the retaining channel 46. Preferably, the head 44 of retaining projection 36 is wider then the retaining channel 46, thereby preventing removal of retaining projection 36 through retaining channel 46. The retaining projection 36 proceeds downwardly through retaining channel 46 until flexing lock tabs 34 snap under lip 48 of contactor housing wall 40. One of ordinary skill will recognize that a different number of retaining projections 36 and connecting slots 38 may be utilized to accomplish a similar connection.

The contactor 12 includes a platform 50 which is integral with and extends substantially transversely to the plane of contactor wall 40. Platform 50 includes supports 52 for supporting contoured coil terminals 54 which extend outwardly from within the contactor 12. Although two contoured coil terminals are shown, it is contemplated that other numbers and arrangements of contoured coil terminals may be utilized. When coupled, the overload relay 14 is placed over the platform 50 to make an electrical connection with contoured coil terminals 54.

Figure 3:
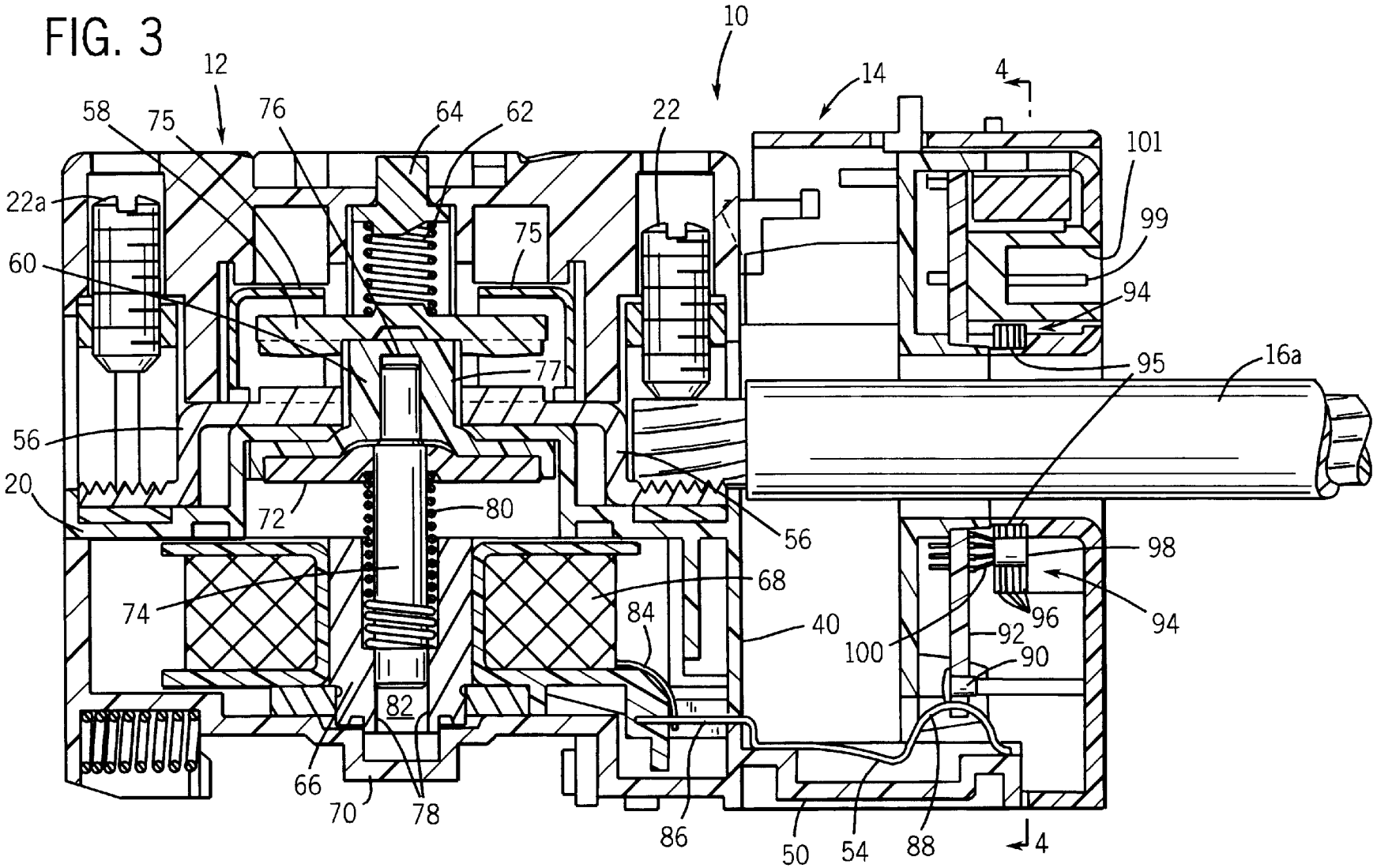
FIG. 3 is a cross-sectional view taken along line 3—3 of FIG. 1 with the contactor and the overload relay connected.

Referring to FIG. 3, the starter 10 is shown with contactor 12 connected to the overload relay 14. The overload relay 14 has a simplified connection to the contactor 12 that includes a snap fit physical connection and an abutting electrical connection, which occur at substantially the same time.

Contactor 12 includes stationary contacts 56 mounted to the contactor housing 20. A moveable contact 58 is mounted to a moveable contact carrier 60. The moveable contact 58 is biased toward the stationary contacts 56 by a moveable contact biasing mechanism 62 which is located between the upper enclosure 64 of the moveable contact carrier 60 and the moveable contact 58.

A magnetic core 66 surrounded by electromagnetic coil 68 in a conventional manner is located on a base portion 70 of contactor housing 20. The magnetic core 66 is preferably a solid iron member. Electromagnetic coil 68 preferably runs on direct current, and as a result, magnetic core 66 need not be as large as other alternating current electromagnet counterparts having similar power capabilities. The overall size of contactor 12 is therefore reduced. When energized, magnetic core 66 attracts armature 72 which is connected to moveable contact carrier 60. Moveable contact carrier 60 along with armature 72 are guided towards the magnetic core 66 with guide pin 74.

Guide pin 74 is press fit or molded securely into moveable contact carrier 60 at one end in an inner surface 76. Guide pin 74 is slidable along guide surface 78 within magnetic core 66. The single guide pin 74 is centrally disposed and is utilized in providing a smooth and even path for the armature 72 and moveable contactor 60 as it travels to and from the magnetic core 66, preventing the side to side motion during movement caused by uneven movement and partial locking of the moveable contact carrier 60. Moveable contact carrier 60 is guided at its upper end 77 by surfaces on the contactor housing 20. Guide pin 74 is partially enclosed by a resilient armature return spring 80, which is compressed as the moveable contact carrier 60 moves toward the magnetic core 66. Armature return spring 80 biases the moveable contact carrier 60 and armature 72 away from magnetic core 66. The combination of the guide pin 74 and the armature return spring 80 helps to provide even downward motion of the moveable contact carrier 60 and helps prevent tilting or locking that may occur during contact closure. The moveable contact carrier 60 is guided along guide surface 78 to help provide a more level path to the magnetic core 66. Additionally, lower end 82 of guide pin 74 may be used to cushion or dampen the downward movement at the end of its downward movement, such as in a dash-pot capacity, to help reduce bounce and cushion the closure of the armature 72 with magnetic core 66. Appropriate tolerancing of the guide pin 74 surfaces 78 and housing 20 promotes its use in this capacity.

Turning now to the electrical connection between the contactor 12 and the overload relay 14, a coil extension 84 extends from electromagnetic coil 68. Coil extension 84 is connected to a contoured coil terminal 54. The contoured coil terminal 54 extends outwardly from wall 40 of contactor 12. Contoured coil terminal 54 extends onto and rests upon platform 50 so as to position itself to abuttingly engage an electrical conductor or rivet 90 which is part of printed circuit board 92 of the overload relay 14. In operation, power is supplied to the printed circuit board 92 through a connector 99, which is sized to receive, for example, a JP1 eight pin connector that plugs into the opening 101 of the overload relay 14. Electrical power is directed through the printed circuit board 92 so as to be available through rivet 90 to establish an electrical connection to the coil 68 when the contoured coil terminal 54 contacts rivet 90, as occurs when the overload relay 14 is snap fit onto contactor 12.

Conductor 16*a*, as is the case with conductors 16*b* and 16*c*, extends through the overload relay 14 into contactor 12 and secured by lugs 22. It is understood that similar connections are made on the opposite side of contactor 12 such that other conductors may be inserted therein and secured by lug 22*a* to complete a current path to contactor 12.

As will be discussed in greater detail in the discussion of FIG. 5, overload relay 14 includes a magnetic flux concentrating shield 94. Because of the desirability of manufacturing the magnetic flux concentrating shield 94 by a stamping process, it is preferably made up of thin layers of laminated members 96 secured together. A magnetic flux sensor, such as a Hall sensor 98, is inserted in the air gaps within each pole of the shield. The Hall sensor 98 is connected to printed circuit board 92 by leads 100 and is soldered to the printed circuit board 92, such that it stands off from the printed circuit board 92. The magnetic flux concentrating shield 94 is precisely positioned in the overload relay housing 20 about wall 95 so as to preserve the alignment of Hall sensor 98. Hall sensor 98 and magnetic flux concentrating shield 94, in combination with printed circuit board 92, provide the necessary current measuring circuitry such that the contactor 12 is protected from and can be disabled during overload currents.

Figure 4:
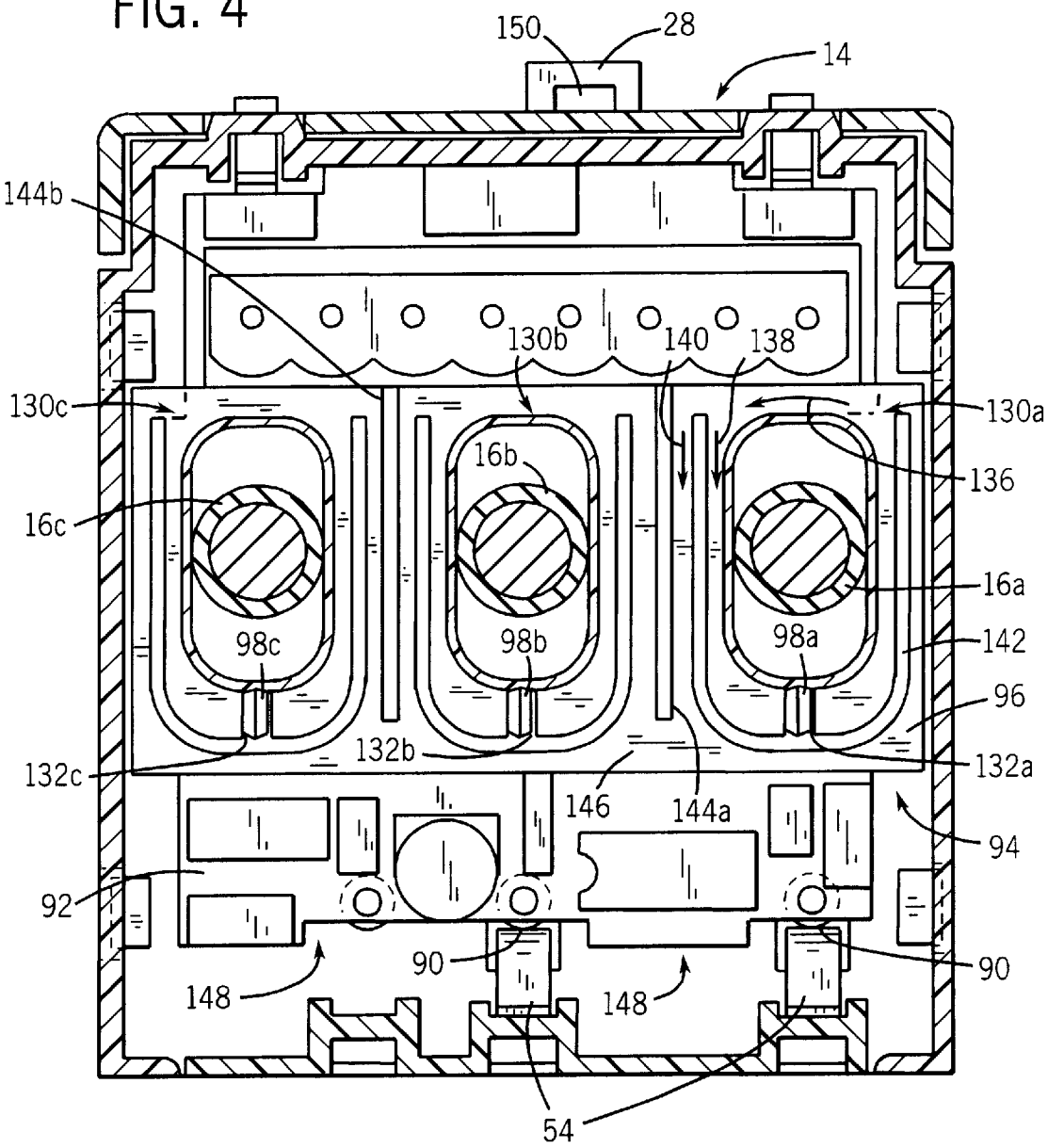
FIG. 4 is a lateral cross-sectional view of the overload relay taken along line 4—4 of FIG. 3.

FIG. 4 is a cross-sectional view of the overload relay 14, and as previously described, includes a magnetic flux concentrating shield 94, which is preferably made up of layers of laminated members 96. Locking hasp 28 is shown extending from overload relay 14. The locking hasp includes a securing hole 150, in which a tamper resistant seal, such as a wire or lead seal, to prevent unauthorized opening of the cover 24.

Figure 5:
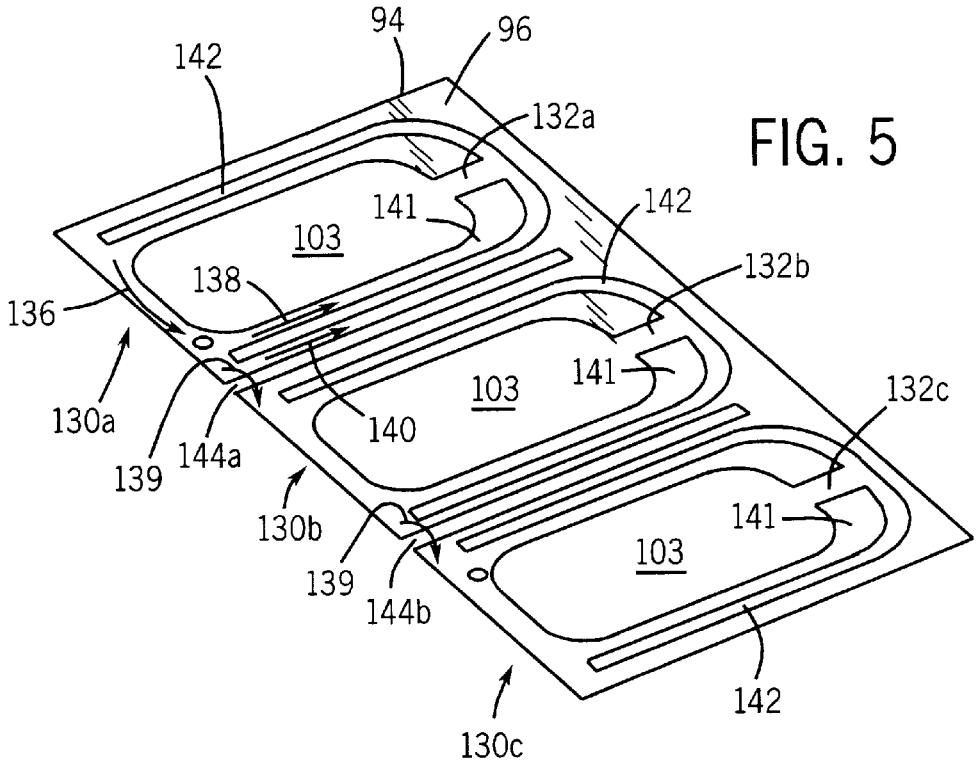
FIG. 5 is prospective view showing a single layer of the magnetic flux concentrating shield in accordance with the present invention.

Referring now to FIG. 5, a single layer 96 of the shield 94 is shown. The shield 94 is preferably constructed of a ferrous material, such as steel, that has a lower magnetic reluctance than air and that is receptive to magnetic flux. It is understood that multiple layers 96 are used to achieve the desired magnetic field strength, but a single layer having a greater thickness may also be suitably employed. Each layer 96 of shield 94 includes a pole section 130*a*, 130*b* and 130*c* for the reception of conductors 16*a*, 16*b* and 16*c* (of FIG. 4) therethrough respectively. Each pole section will receive generated magnetic flux proportionately to the magnitude and phase of the current passing through that pole section. Each pole section 130*a*, 130*b* and 130*c* includes an air gap 132*a*, 132*b*, and 132*c* into which resides a magnetic flux sensor, such as Hall sensors 98*a*, 98*b* and 98*c*. Hall sensors are utilized because they are small and fit easily within the space available in the overload relay. Because of the reduced available area, the spacing between individual poles can cause the Hall sensor in one pole to sense (additional) stray flux from an adjacent pole. During operation, current flows through conductor 16*a* in a direction passing transversely through member 96. Such a current creates a magnetic flux path in a counter clockwise direction as indicated by arrow 136. Flux path 136, for example, is divided between inner flux path 138 on inner flux path section 141, and outer flux path 140 which are divided by U shaped channels 142. Outer flux path 140, which provides an avenue for stray magnetic flux, is substantially prevented by pole shielding slot 144*a* from traveling directly to pole section 130*b*, but some stray flux does travel via gaps 139. The magnetic flux to be measured is concentrated into primary flux path 138, where it must jump through the air gap 132*a*, and ultimately through Hall sensor 98*a*. The elongated path created by pole shielding slots 144*a* and similarly 144*b* not only concentrates the magnetic flux to be measured for a particular pole into the Hall sensor for that pole, but also minimizes any stray magnetic flux from taking the elongated path or via gaps 139, thereby shielding the Hall sensors of the adjacent poles from the effects of cross pole magnetic flux interference. U-shaped channels 142, it will be recognized, also prevent magnetic flux from influencing Hall sensors 98*a*, 98*b* and 98*c* of adjacent poles, and therefore are considered pole shielding slots as well. Any configuration and placement of the pole shielding slots and U-shaped channels that minimizes magnetic flux transfer between pole sections is contemplated by the present invention. Additionally, although two pole shielding slots 144*a* and 144*b* and three U-shaped channels such as 142 are shown, it will be recognized that more pole shielding slots such as 144*a* and 144*b*, and additional channels 142, in various configurations and shapes, may also be utilized to minimize cross-pole magnetic flux interference.

The amount of magnetic flux lines going across airgaps 132*a*–132*c* is determined by both the length and width of the airgaps. The particular shielding and flux concentrating characteristics of the magnetic flux concentrating shield 94 are determined by the placement, configuration and widths of the linear pole shielding slots 144*a*–144*b* and U-shaped channels, or contoured pole shielding slots 142.

Figure 6:
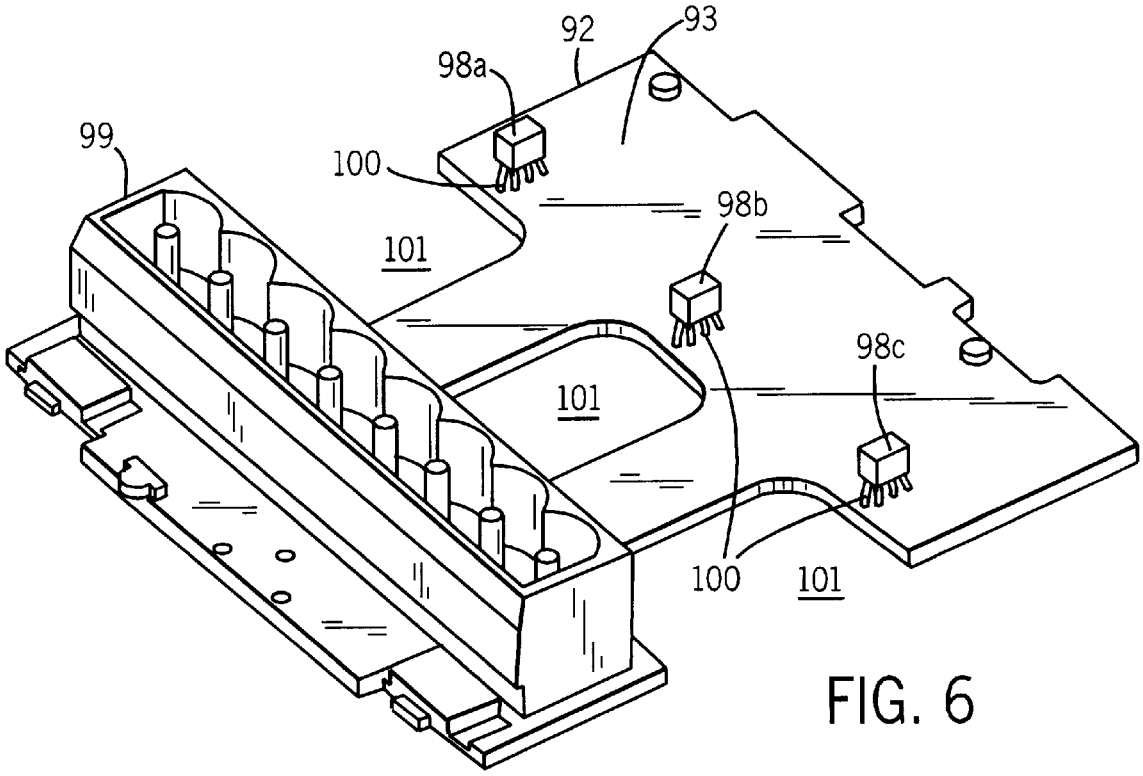
FIG. 6 is a perspective view of a simplified printed circuit board from the overload relay showing the magnetic flux sensors that are positioned within the magnetic flux concentrating shield of FIG. 5.

Referring now to FIGS. 5–6, the printed circuit board 92 is shown without its associated electrical components except for Hall sensors 98*a*, 98*b*, and 98*c* and JP1 connector 99. Hall sensors 98*a*–98*c* are lifted off from the surface 93 of print circuit board 92 by leads 100. The Hall sensors 98*a*–98*c* stand off from the surface of the printed circuit board 92 so as to be self aligning within the air gaps 132*a*–132*c*. The printed circuit board 92 and the magnetic flux concentrating shield 94 are both secured within the overload relay housing 20, FIG. 3 and 4, so as not to disturb the precise placement and orientation of the Hall sensors, which must be positioned with their sensitive faces perpendicular to the direction of magnetic flux. Printed circuit board 92 also includes openings 101 to receive conductors therethrough. In operation, multiple layers of magnetic flux concentrating shield 94 are placed such that Hall sensors 98*a*–98*c* are positioned within airgaps 132*a*–132*c* of the magnetic flux concentrating shield 94. Conductor apertures 103 correspond with the openings 101 to allow conductors through the printed circuit board 92 and the magnetic flux concentrating shield 94. The net effect is that the current conducted through each of the conductors 16*a*–16*c* produces a magnetic flux through the shield 94 into Hall sensors 98*a*–*c* to obtain the current measurement for that conductor.

The present invention has been described in terms of the preferred embodiment, and it is recognized that equivalents, alternatives, and modifications, aside from those expressly stated, are possible and within the scope of the appending claims.

For example, the magnetic flux concentrating shield 94 may have many combinations and sizes of pole shielding slots and channels to effectively prevent cross-pole magnetic flux sensor corruption.

What is claimed is:

1. A magnetic flux concentrating shield comprising:

a slotted layer having a plurality of poles and having a plurality of conductor apertures, each conductor aperture capable of receiving a current carrying conductor therethrough, and including a series of pole shielding slots which are at least partially located between the conductor apertures, each pole having an inner magnetic flux path section on the layer surrounding each conductor aperture;

wherein when magnetic flux is generated by a current carrying conductor in a conductor aperture, the magnetic flux is concentrated within each respective pole and stray magnetic flux is substantially shielded from the inner magnetic flux path section of an adjacent pole by the pole shielding slots wherein the slotted layer is connected to and resides in an overload relay.

2. The magnetic flux concentrating shield of claim 1 wherein the slotted layer includes an air gap within each pole capable of receiving a magnetic flux sensor, the airgap located along the inner magnetic flux path and integral with the conductor aperture;

and wherein the pole shielding slots minimize the stray magnetic flux of one pole from entering the inner magnetic flux path section of an adjacent pole to prevent the stray magnetic flux from being sensed by the magnetic flux sensor of the adjacent pole.

3. The magnetic flux concentrating shield of claim 2 further comprising a magnetic flux sensor locatable in the air gap of the slotted layer.

4. The magnetic flux concentrating shield of claim 3 wherein the magnetic flux sensor is connected to and operatively associated with a printed circuit for providing power to a contactor.

5. The magnetic flux concentrating shield of claim 1 wherein the slotted layer is constructed of a material having a lower magnetic reluctance than air.

6. The magnetic flux concentrating shield of claim 1 wherein the slotted layer is constructed of a ferrous material.

7. The magnetic flux concentrating shield of claim 6 wherein the ferrous material is steel.

8. The magnetic flux concentrating shield of claim 1 wherein the slotted layer is stamp manufactured.

9. The magnetic flux concentrating shield of claim 1 wherein the slotted layer is a single laminate capable of being stacked to create a magnetic flux concentrating shield comprised of a plurality of single laminates.

10. A magnetic flux concentrating shield comprising a plurality of slotted layers, each slotted layer having (A) a first, second, and third conductor aperture corresponding to a first, second, and third pole, each conductor aperture capable of receiving a current carrying conductor therethrough, and having (B) pair of substantially linear pole shielding slots, each linear pole shielding slot at least partially located between the conductor apertures, each pole having an inner magnetic flux path section surrounding each conductor aperture and having a contoured pole shielding slot surrounding each inner magnetic flux path section; and wherein when magnetic flux is generated by a current carrying conductor in each of the poles, the magnetic flux is concentrated within each respective pole and stray magnetic flux is substantially shielded from the inner magnetic flux path section of another of the poles by the substantially linear pole shielding slots and the contoured pole shielding slots.

11. The magnetic flux concentrating shield of claim 10 wherein each slotted layer includes an air gap within each pole capable of receiving a magnetic flux sensor, the airgap located along the inner magnetic flux path section and integral with the conductor aperture;

and wherein the pole shielding slots minimize stray magnetic flux of one pole from entering the inner magnetic flux path section of an adjacent pole to prevent the stray magnetic flux from being sensed by the magnetic flux sensor of the adjacent pole.

12. The magnetic flux concentrating shield of claim 11 further comprising a magnetic flux sensor located in the air gap of the slotted layer.

13. The magnetic flux concentrating shield of claim 12 wherein the magnetic field sensor is connected to and operatively associated with a printed circuit board for providing power to a contactor.

14. The magnetic flux concentrating shield of claim 10 wherein each slotted layer is constructed of a material having a lower magnetic reluctance than air.

15. The magnetic flux concentrating shield of claim 10 wherein each slotted layer is constructed of a ferrous material.

16. The magnetic flux concentrating shield of claim 15 wherein the ferrous material is steel.

17. The magnetic flux concentrating shield of claim 10 wherein each slotted layer is stamp manufactured.

18. The magnetic flux concentrating shield of claim 10 wherein 4 each slotted layer is a single laminate capable of being stacked to create a magnetic flux concentrating shield comprised of a plurality of single laminates.

19. The magnetic flux concentrating shield of claim 10 wherein the plurality of slotted layers are connected to and resides in an overload relay.

20. A magnetic flux concentrating shield comprising:

a plurality of pole sections, each pole section having an aperture to receive a conductor transversely therethrough and comprising:

an inner magnetic flux path section having an air gap;

a magnetic flux sensor disposed within the air gap of the inner magnetic flux path section; and a plurality of pole shielding slots, such that when electrical current flows through the conductor of each pole section, magnetic flux flowing in each pole section is substantially prevented by the pole shielding slots from reaching the magnetic flux sensor in the inner magnetic flux path section of another of the plurality of pole sections, thereby minimizing cross-pole magnetic flux sensor interference.

21. The magnetic flux concentrating shield of claim 20 wherein the magnetic flux concentrating shield comprises a plurality of laminated layers.

22. The magnetic flux concentrating shield of claim 21 wherein each laminated layer is stamp manufactured.

23. The magnetic flux concentrating shield of claim 21 wherein the plurality of laminated layers are connected to and reside in an overload relay.

24. The magnetic flux concentrating shield of claim 20 wherein the magnetic flux sensor is a Hall sensor.

25. The magnetic flux concentrating shield of claim 20 wherein there are three pole sections.

26. The magnetic flux concentrating shield of claim 20 wherein each pole shielding slot is located between the inner magnetic flux path section of one pole section and the inner magnetic flux path section of another pole section.

* * * * *